US008806712B2

(12) United States Patent
Griffith

(10) Patent No.: US 8,806,712 B2
(45) **Date of Patent: *Aug. 19, 2014**

(54) VACUUM ACCESSORY TOOL

(75) Inventor: Aaron P. Griffith, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/544,397

(22) Filed: Jul. 9, 2012

(65) Prior Publication Data

US 2012/0272473 A1 Nov. 1, 2012

Related U.S. Application Data

(63) Continuation of application No. 12/346,245, filed on Dec. 30, 2008, now Pat. No. 8,214,968.

(60) Provisional application No. 61/021,708, filed on Jan. 17, 2008.

(51) Int. Cl.
*A47L 9/02* (2006.01)

(52) U.S. Cl.
USPC ..... 15/415.1; 15/321; 15/344

(58) Field of Classification Search
USPC ..... 15/321, 344, 415.1
See application file for complete search history.

(56) References Cited

U.S. PATENT DOCUMENTS

| | | | | |
|---|---|---|---|---|
| 2,637,062 | A | 5/1953 | Sutton et al. | |
| 2,915,774 | A | 12/1959 | Darrow | |
| 5,207,498 | A | 5/1993 | Lawrence et al. | |
| 5,983,443 | A | 11/1999 | Redding | |
| 6,711,777 | B2 | 3/2004 | Frederick et al. | |
| 6,792,645 | B2 | 9/2004 | Ruff | |
| 2002/0038488 | A1 | 4/2002 | Paterson et al. | |
| 2005/0115014 | A1 | 6/2005 | Worwag | |
| 2006/0076035 | A1 | 4/2006 | McGee et al. | |
| 2006/0096057 | A1 | 5/2006 | Chatfield | |
| 2006/0179599 | A1 | 8/2006 | Miner et al. | |
| 2006/0248680 | A1* | 11/2006 | Heidenga et al. | 15/387 |
| 2006/0272120 | A1* | 12/2006 | Barrick et al. | 15/321 |
| 2007/0143954 | A1 | 6/2007 | Graham et al. | |
| 2007/0192987 | A1 | 8/2007 | Garcia et al. | |
| 2007/0240275 | A1 | 10/2007 | Willenbring | |
| 2008/0271282 | A1* | 11/2008 | Gebhard et al. | 15/347 |
| 2008/0313846 | A1* | 12/2008 | Steffen et al. | 15/339 |
| 2010/0313379 | A1 | 12/2010 | Milanese | |

FOREIGN PATENT DOCUMENTS

| | | | | |
|---|---|---|---|---|
| DE | 4206190 | A1 | 5/1993 | |
| EP | 1479334 | A2 | 11/2004 | |
| JP | 3051025 | A | 7/1989 | |
| JP | 6070873 | A | 8/1989 | |
| JP | 8010203 | A | 4/1994 | |
| SE | 0700357 | A | 3/2007 | |
| WO | 2004089179 | A2 | 10/2004 | |
| WO | WO2006/015390 | * | 2/2006 | A47L 7/04 |
| WO | 2006133886 | A1 | 12/2006 | |

* cited by examiner

*Primary Examiner* — Lee D Wilson
*Assistant Examiner* — Shantese McDonald
(74) *Attorney, Agent, or Firm* — McGarry Bair PC

(57) ABSTRACT

A vacuum accessory tool comprises a nozzle body that forms a suction nozzle and at least one light emitting element that emits light in an ultraviolet (UV) spectrum that will illuminate stains on the surface to be cleaned. The light is projected forwardly of the suction nozzle body so that stains on the surface will be visible to a user as the vacuum accessory tool is moved over the surface.

14 Claims, 10 Drawing Sheets

VACUUM ACCESSORY TOOL

CROSS-REFERENCE TO RELATED APPLICATIONS

This application is a continuation of U.S. patent application Ser. No. 12/346,245, filed Dec. 30, 2008, and claims the benefit of U.S. Provisional Patent Application No. 61/021,708, filed Jan. 17, 2008, both of which are incorporated herein by reference in their entirety.

BACKGROUND OF THE INVENTION

1. Field of the Invention

The invention relates to dry vacuum and wet extractor cleaning accessory tools. In one of its aspects, the invention relates to a vacuum accessory tool adapted to clean carpet and other fabric surfaces while illuminating the surfaces thereof. In another aspect, the invention relates to a vacuum accessory tool that emits ultraviolet (UV) light for illumination and for treatment of certain organic stains including pet stains on a surface to be cleaned. In still another aspect, the invention relates to a vacuum accessory tool that sanitizes and/or disinfects a cleaning surface. In yet another aspect, the invention relates to an illuminated vacuum accessory tool having an agitator assembly that is powered via an air-driven turbine assembly.

2. Description of the Related Art

Attachments and accessory tools for use with household vacuum cleaners and extraction machines typically include various brushes, nozzles, powered brush attachments, and the like. Further, some vacuum tools have included a lighting element that is powered directly from line voltage, tapped off of the vacuum motor windings, or powered by a secondary battery pack routed to the device via commonly known wires and switches.

U.S. Patent Application Publication No. 2006/0272120 to Barrick et al. discloses an extraction cleaning device with a combination of UV lights located on a cleaning head at various positions near the point of fluid delivery. Various cleaning heads are disclosed including stationary, motorized, and ultra-sonic agitator element configurations.

U.S. Patent Application Publication No. 2007/0240275 to Willenbring discloses a cleaning attachment for a vacuum cleaner that includes a lighting device. The cleaning attachment comprises a housing, a lighting device, a dedicated battery pack, and an associated control circuit further comprising a power switch and timing device with provisions for automatic power shut-off after a pre-determined wait time via the timing device.

U.S. Pat. No. 6,792,645 to Ruff discloses a lighted refrigerator coil cleaning tool for attachment to a vacuum cleaner hose. The cleaning tool comprises a flattened tubular housing including an integral light source with associated battery and power switch.

U.S. Pat. No. 5,983,443 to Redding discloses an accessory attachment including a built-in light for attachment to a vacuum cleaner. The accessory attachment serves as an intermediate connection between the vacuum suction hose and various interchangeable accessory tools. A cuff portion contains lighting elements that are positioned circumferentially around the air path connection portion. Power is provided from a dedicated battery pack or from the main unit power supply line.

U.S. Pat. No. 2,637,062 to Sutton et al. discloses a light bulb on the cleaning head of a canister vacuum. Power to the light bulb is provided by the main unit power supply and delivered via connectors embedded in the vacuum hose.

U.S. Patent Application Publication No. 2006/0096057 to Chatfield discloses a transparent illumination accessory for a vacuum cleaner. The accessory comprises a transparent coupling member that illuminates the surface to be cleaned and offers the operator a clear line of sight to the debris being vacuumed. Power is provided from main line power via connectors that are embedded in the vacuum hose.

U.S. Pat. No. 6,711,777 to Frederick et al. discloses a turbine powered vacuum cleaner tool wherein a nozzle body encloses an agitator located adjacent an elongated suction inlet opening. A turbine rotor is rotatably connected to the nozzle body and operatively connected to the agitator so that airflow generated by a remote suction source flows through the nozzle body and rotates the agitator.

SE0700357 discloses what appears to be a floor tool which is used with a canister vacuum cleaner. The floor tool is connected to the canister vacuum through a wand and a hose. The wand has mounted thereon fluorescent tubes that are crossways to the upright wand and are said to be designed to illuminate white or fluorescent dust particles on the floor which would not normally be seen under visible light.

SUMMARY OF THE INVENTION

A vacuum accessory cleaning tool according to the invention comprises a nozzle body, a suction nozzle formed by the nozzle body, an opening formed in the nozzle body and adapted to be connected to a suction source remote from the nozzle body for generating a working air flow from the suction nozzle through the nozzle body, and at least one light emitting element that emits light in an ultraviolet (UV) spectrum that will illuminate stains on the surface, the light emitting element being mounted on a leading edge of the nozzle body, whereby light is projected forwardly of the suction nozzle body so that stains on the surface will be visible to a user as the vacuum accessory tool is moved over the surface.

In one embodiment, the at least one light emitting element is at least one light emitting diode (LED).

In another embodiment, the at least one light emitting element is configured to emit light that sanitizes or disinfects the surface.

In another embodiment, the at least one light emitting element further comprises a convex lens to disperse light emitted from the at least one light emitting element.

In a further embodiment, the vacuum accessory tool comprises a power generator mounted on the nozzle body. The power generator includes an air-driven turbine for producing mechanical energy that is converted into electrical energy for powering the at least one light-emitting element. In one embodiment, the power generator further comprises a motor that is driven by the air-driven turbine and that forms an electromagnetic inductive circuit with the at least one electrical element to supply electrical energy to the at least one light-emitting element. Further, the power generator can comprise a plurality of permanent magnets mounted to the air-driven turbine and an inductor coil positioned adjacent the air-driven turbine so as to generate current in an electromagnetic circuit by the magnets cyclically passing across the inductor coil to supply electrical energy to the at least one light-emitting element. In another embodiment, the vacuum accessory tool further comprises an agitator mounted to the nozzle body and operably coupled to the air-driven turbine for rotation therewith. The agitator can be a brush that is rotatable about a horizontal axis.

In yet another embodiment, the vacuum accessory tool further comprises a hair removal element on the nozzle body for aiding in the removal of hair from the surface to be cleaned.

In a further embodiment, the vacuum accessory tool comprises a fluid delivery element for selectively distributing cleaning fluid onto the surface to be cleaned.

DESCRIPTION OF THE PREFERRED EMBODIMENTS

Figure 1:
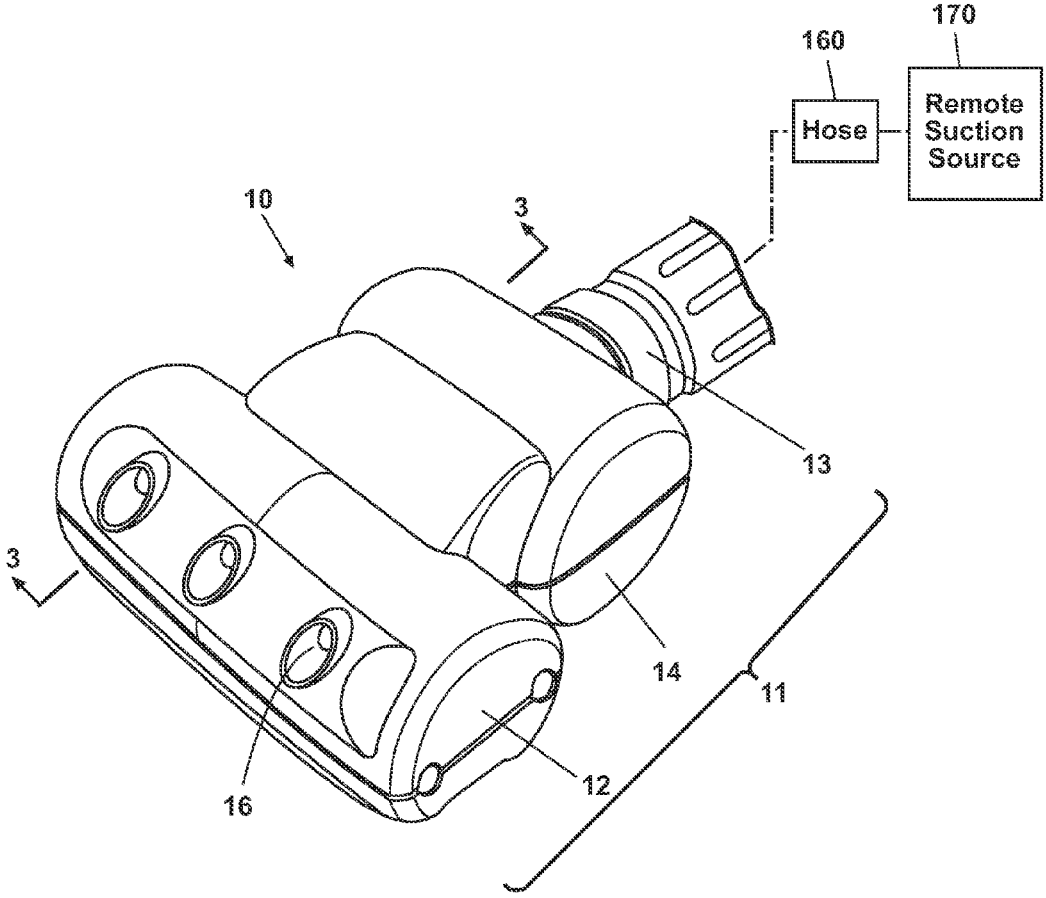
FIG. 1 is a front perspective view of a vacuum accessory tool with an illumination element according to a first embodiment of the invention.
Figure 2:
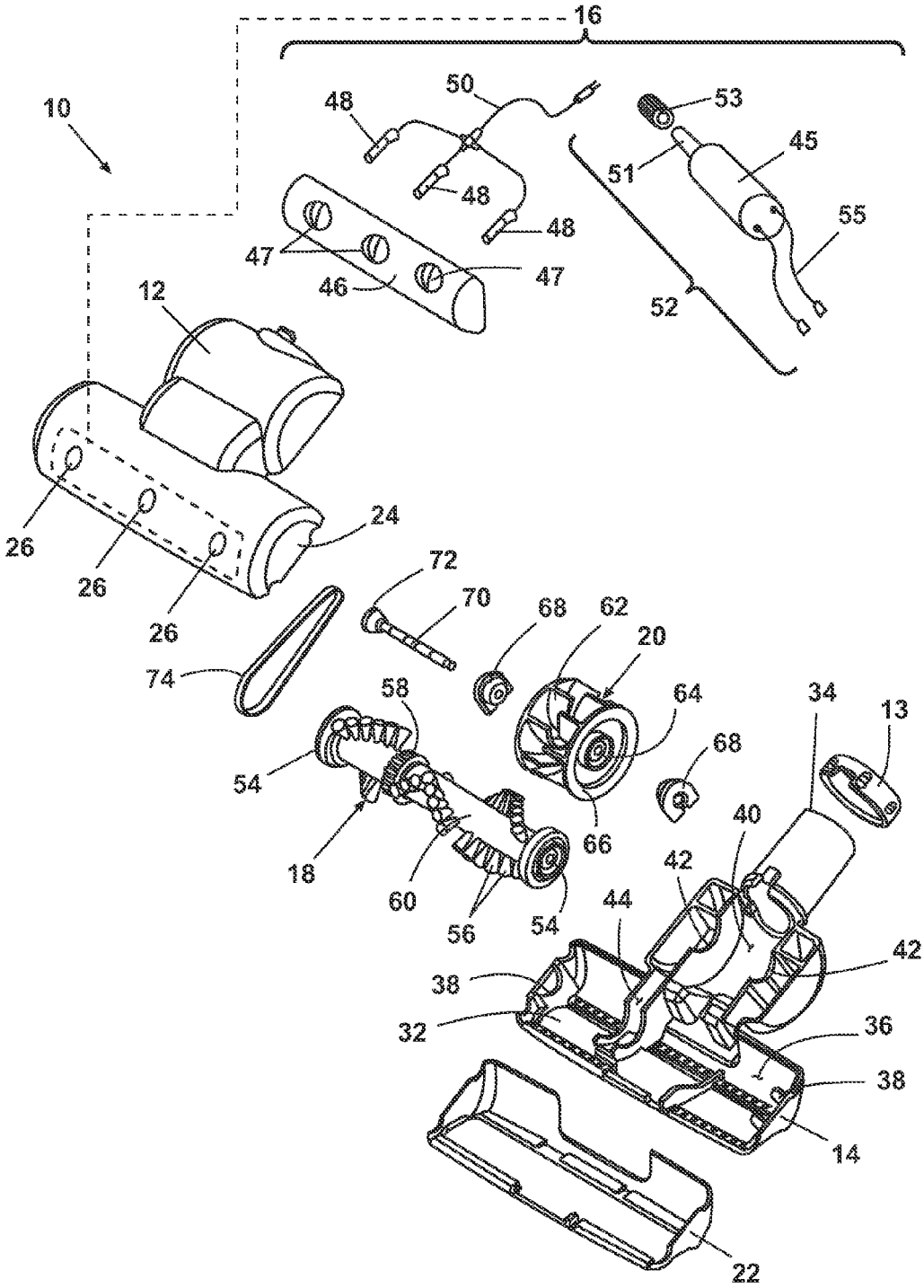
FIG. 2 is an exploded view of the vacuum accessory tool shown in FIG. 1

Referring to the drawings and particularly FIGS. 1-2, a vacuum accessory tool 10 according to a first embodiment of the invention comprises a nozzle body 11 formed by an upper housing 12 and a lower housing 14 secured together by a rotatable and removable retaining ring 13. The tool 10 further comprises an illumination element 16 and an agitator assembly 18, both of which may be operatively coupled to and powered by an impeller assembly 20 that is in turn powered by a working airflow passing through the tool 10. A more detailed description of the basic operation of an impeller-driven accessory tool is provided in U.S. Patent Application Publication No. 2006/0248680 to Heidenga et al. The tool 10 can be fluidly connected to a remote suction source 170. The remote suction source 170 can be a vacuum cleaner, to which the tool 10 is fluidly coupled by attaching a conventional vacuum hose 160 to the tool 10.

In the illustrated embodiment, a suction nozzle 32 is formed at a forward, lower portion of the lower housing 14. The lower housing 14 further comprises a working air conduit 34 positioned on an end of the nozzle body 11 opposite the suction nozzle 32. The working air conduit 34 is configured to be connected to the vacuum hose 160 to couple the tool 10 to the remote suction source 170.

A lower agitator chamber 36 is formed at a forward portion of the lower housing 14 in close proximity to and in fluid communication with the suction nozzle 32. The agitator assembly 18 is mounted within the lower agitator chamber 36 and is enclosed by an upper agitator cover 24 formed at a forward portion of the upper housing 12. The agitator assembly 18 comprises a commonly-known brushroll including a dowel 60 that supports a plurality of bristles 56. The dowel 60 further comprises bearing assemblies 54 at either end thereof and a fixed agitator pulley 58 intermediate to the bearing assemblies 54. The bearing assemblies 54 are mounted to corresponding brush bearing supports 38 formed in the lower agitator chamber 36.

An impeller chamber 40 formed between the suction nozzle 32 and the working air conduit 34 receives the impeller assembly 20. In the illustrated embodiment, the impeller assembly 20 comprises an air-driven turbine having a plurality of arcuate blades 62 surrounding an impeller hub 64 and a pair of bearing assemblies 68 received by bearing supports 42 formed in the lower housing 14 on opposite sides of the impeller chamber 40. The impeller assembly 20 is fixedly mounted on an axle 70 that passes through the impeller hub 64 and defines an axis about which the impeller assembly 20 rotates. A belt pulley 72 is fixedly attached to the axle 70 and resides within a belt compartment 44 when the tool 10 is assembled. The belt compartment 44 is formed adjacent the impeller compartment 40 and extends to the lower agitator chamber 36 and receives a drive belt 74 which mechanically couples the belt pulley 72 of the impeller assembly 20 to the agitator pulley 58 of the agitator assembly 18. The drive belt 74 is maintained under tension so that rotation of the belt pulley 72 induces rotation of the agitator pulley 58, thereby rotating the dowel 60.

The illumination element 16 is preferably positioned on a leading edge of the tool 10, adjacent to the suction nozzle 32, to effectively illuminate the surface to be cleaned. The illumination element 16 comprises at least one light emitting element 48, a cover 46, and a power source. The light emitting element 48 is chosen from a range of optional light emitting elements based upon the desired effect and dictated by the range in the light spectrum. For example, illumination of the surface to be cleaned requires a light source in the visible light spectrum with a wavelength of at least 400 nanometers. Other options include various ranges in the ultraviolet light (UV) spectrum. For example, light in the UVA range comprising a wavelength from about 400 nanometers to about 320 nanometers (also known as "black light") is effective for illuminating carbon-based stains, including pet stains such as urine stains. UVA light causes carbon-based stains to fluoresce, thus making the previously invisible stain visible to the eye. Furthermore, it is known that illuminating certain peroxygen cleaning compounds with UVA light can improve cleaning efficacy and decrease the cleaning time. The light emitting element 48 can be chosen to have a sanitization or disinfection action on the surface to be cleaned. Disinfecting the surface to be cleaned is best achieved with a UVC wavelength of about 260 nanometers, however wavelengths from about 280 nanometers to about 100 nanometers are also effective. Once the desired effect is known, the light emitting element 48 can be chosen from known constructions, including light emitting diodes (LED), incandescent, fluorescent, and combinations thereof. Furthermore, multiple dissimilar light emitting element types can be incorporated into the illumination element 16. Use of a commonly known selector or toggle switch can allow selection of UVA, UVC, and/or visible light independently, or, in various combinations depending on the specific cleaning requirement.

Figure 3:
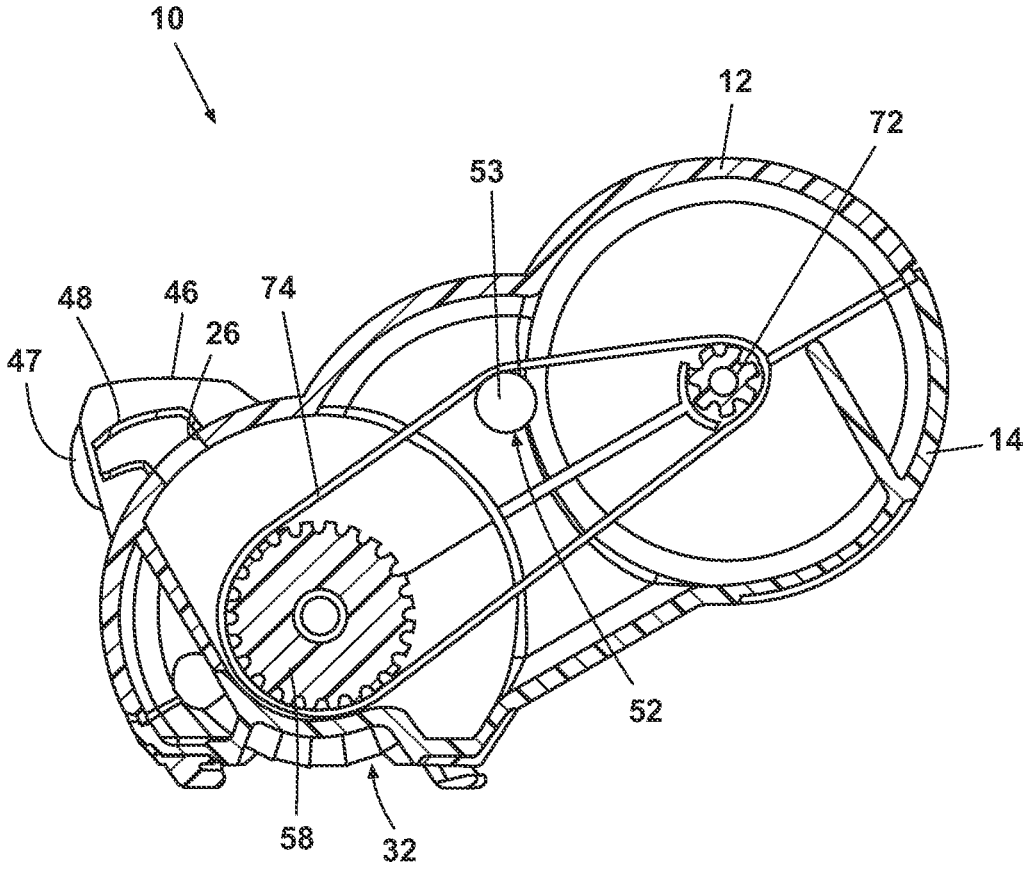
FIG. 3 is a section view taken along line 3-3 of FIG. 1 showing a drive train of the vacuum accessory tool.

Referring to FIGS. 2 and 3, at least one mounting recess 26 can be formed on a leading surface of the upper agitator cover 24 in which the light emitting element 48 may be positioned. The cover 46 is mounted on the upper agitator cover 24 to enclose the mounting recesses 26 and can include at least one lens 47 to allow light from the light emitting element 48 to pass through the cover 46. The lens 47 can be transparent or translucent and can advantageously be convex-shaped to disperse the light emitted by the light emitting element 48. Alternately, the cover 46 can be made from a transparent or translucent material thereby transmitting light from the light emitting element 48 through the cover without need for a lens. The cover 46 can also include integral mounting features (not shown) to house and retain the light emitting element 48.

The vacuum accessory tool 10 further comprises a power source for supplying power to the illumination element 16. In the preferred embodiment, the power source is a power generator 52 which produces electrical energy from mechanical energy. The illumination element 16 includes wire conductors 50 that connect the light emitting element 48 to the power generator 52. In the preferred embodiment, the power generator 52 comprises a motor 45 that functions by converting kinetic/mechanical energy into electrical energy, i.e. rotational motion into electricity, and is driven by the drive belt 74 that mechanically connects the air-driven impeller assembly 20 to the agitator brush assembly 18 for cooperative rotation. Thus, the air-driven impeller assembly 20 can be considered a part of the power generator 52 since it provides the mechanical energy that is converted to electrical energy. The motor 45 comprises a motor shaft 51 having a motor pulley 53 fixedly connected thereto which is coupled by the drive belt 74 to the belt pulley 72. As shown in FIG. 3, the motor pulley 53, agitator pulley 58, and belt pulley 72 are generally arranged in a triangular formation so that one belt 74 can be used to drive both the motor 45 and the agitator assembly 18. Alternately, two separate belts (not shown) could be provided, one coupling the belt pulley 72 to the motor pulley 53 and the other coupling the belt pulley 72 to the agitator pulley 58. The motor 45 has output leads 55 that are connected to the conductors 50 through a suitable socket (not shown). The motor 45 can be mechanically mounted either to the upper housing 12, lower housing 14 or a combination thereof via mounting features (not shown) formed in the nozzle body 11, and can comprise a low voltage direct current (LVDC) motor.

The tool 10 can optionally further comprise a hair removal element 22 for aiding in the removal of pet hair from the surface to be cleaned. The hair removal element 22 is preferably associated with the suction nozzle 32 and can be mounted to the underside of the lower housing 14 in the area of the lower agitator chamber 36. The material of the hair removal element 22 can be selected such that it creates an electrostatic charge when in contact with and moving relative to the surface to be cleaned. The electrostatic charge attracts pet hair and other debris on the surface and holds the pet hair and other debris in the vicinity of the suction nozzle 32 for ingestion therethrough. Details of several suitable hair removal elements are provided in the above-referenced Heidenga application.

In operation, a remote suction source 170 is energized to create a working air flow through a hose 160 that connects the tool 10 with the remote suction source 170 at the working air conduit 34 to draw working air through the suction nozzle 32. Working air is pulled through the suction nozzle 32, into the impeller chamber 40, and subsequently induces rotation of the impeller assembly 20. When the blades 62 of the impeller assembly 20 are exposed to a moving air stream, such as that created by the remote suction source 170, the axle 70 rotates with the blades 62, and the belt pulley 72 rotates with the axle 70. The belt pulley 72, in turn, drives the drive belt 74, which rotates the motor pulley 53 and the agitator pulley 58. The rotation of the motor shaft 51 cooperatively rotates the internal armature (not shown) which is also connected to the motor shaft 51 and induces an electro-motive force (e.g. "emf" or voltage) in the circuit, ultimately providing power to the lighting element 48.

Referring to FIGS. 4 through 9 a third embodiment of the invention is shown, which comprises a wet extractor accessory tool 80. The tool 80 comprises a main housing 82 having an illumination element 84 and an agitator assembly 86, both of which may be operatively coupled to and powered by an impeller assembly 90 which is in turn powered by air passing through the tool 10. The tool 80 may be fluidly connected to a remote suction source 170. The remote suction source 170 is typically a vacuum cleaner, carpet cleaner, or extractor to which the tool 10 is fluidly coupled by attaching a conventional vacuum hose 160 to the tool 80.

Figure 5:
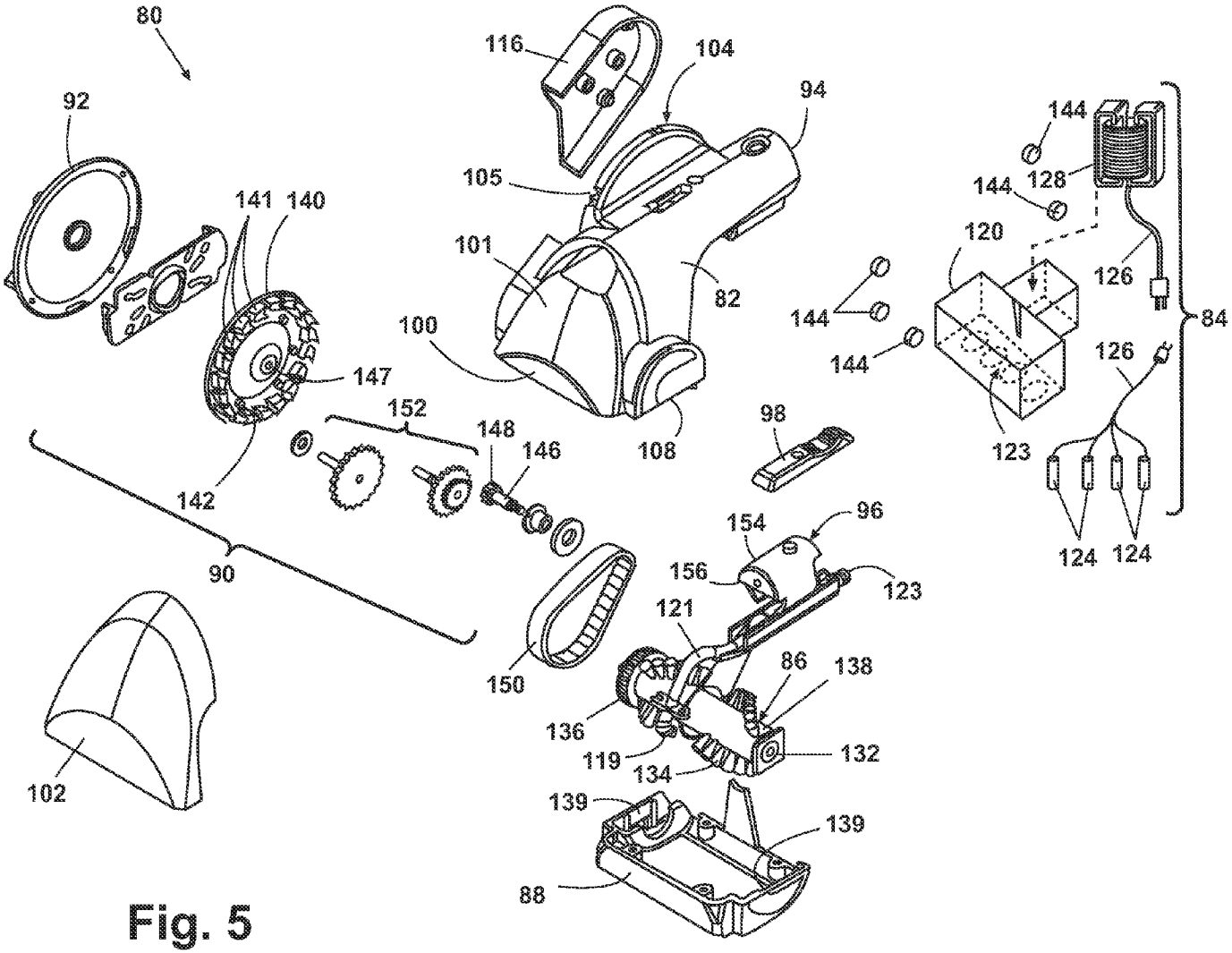
FIG. 5 is an exploded view of the extractor accessory tool shown in FIG. 4.
Figure 7:
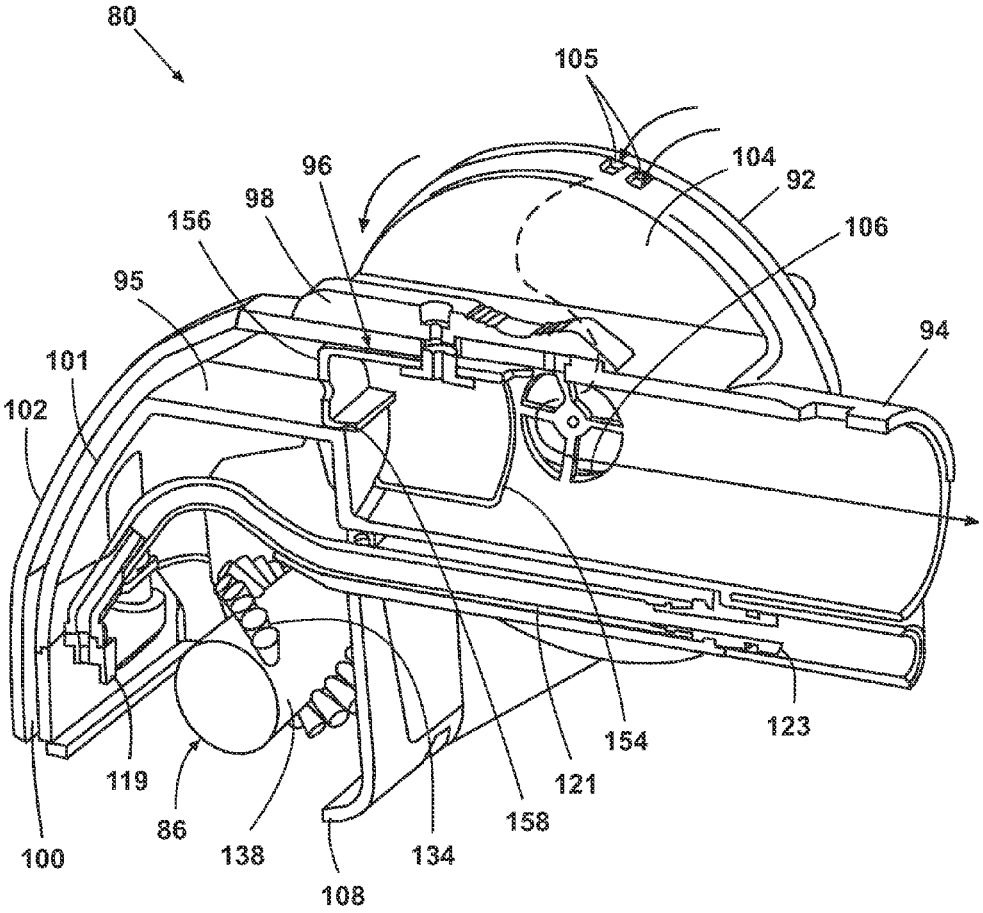
FIG. 7 is a sectioned partial view taken along line 7-7 of FIG. 4 showing a suction selector valve of the extractor accessory tool in a first operating position.

Referring to FIGS. 5 and 7, a suction nozzle 100 is formed at a forward portion of the main housing 82 and is defined between a rear nozzle body 101, which can be integrally formed with the main housing 82, and a front nozzle window 102. The main housing 82 further comprise a working air conduit 94 positioned on an end of the main housing 82 opposite the suction nozzle 100. The working air conduit 94 is configured to be connected to the vacuum hose 160 to couple the tool 10 to the remote suction source 170. The working air conduit 94 is in fluid communication with the suction nozzle 100 via a connecting conduit 95.

An agitator chamber 108 is formed in the main housing 82 rearwardly of the suction nozzle 100. The agitator assembly 86 is mounted within the agitator chamber 108 and is enclosed by a lower agitator cover 88. The agitator assembly 86 may comprise a commonly-known brushroll comprising a dowel 138 that supports a plurality of bristles 134. The dowel 138 further comprises bearing assemblies 132 at both ends thereof and a fixed agitator pulley 136 intermediate to the bearing assemblies 132. The bearing assemblies 132 are mounted to corresponding bearing supports 139 formed in the lower agitator cover 88.

An impeller chamber 104 is formed on one side of the main housing 82 and receives the impeller assembly 90, which is enclosed by an impeller cover 92 that attaches to the impeller chamber 104. The impeller chamber 104 is in fluid communication with the working air conduit 94, and thus the remote suction source 170, via an outlet opening 106 (FIG. 7). Air is drawn into the impeller chamber 104 through at least one inlet opening 105 formed in the periphery of the impeller chamber 104. In the illustrated embodiment, the impeller assembly 90 comprises an air-driven turbine fan 140 having a plurality of arcuate blades 141 surrounding an impeller hub 147. The turbine fan 140 is fixedly mounted on an axle 146 that passes through the impeller hub 147 and defines an axis about which the turbine fan 140 rotates. A belt pulley 148 is fixedly attached to the axle 146.

Figure 6:
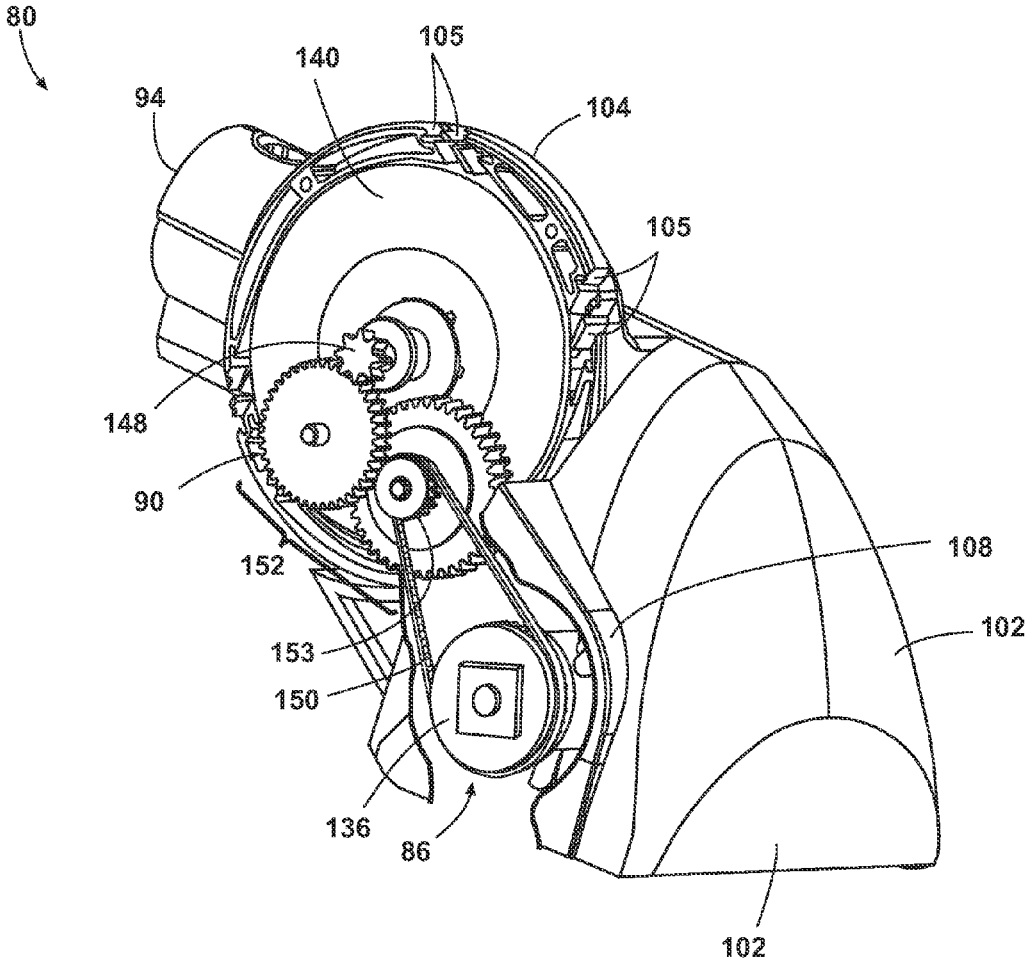
FIG. 6 is a perspective view of the extractor accessory tool shown in FIG. 4, with portions of the extractor accessory tool removed for clear visibility to internal components.

As illustrated in FIG. 6, the belt pulley 148 drives a reduction spur gear train 152, which includes a drive pinion 153 that is mechanically coupled to the agitator pulley 136 by a drive belt 150, thereby operably coupling the impeller assembly 90 to the agitator assembly 86. The drive belt 150 is maintained under tension so that rotation of the drive pinion 153 induces rotation of the agitator pulley 136, thereby inducing rotation of the dowel 138.

The tool 80 can optionally include a fluid delivery element for selectively distributing cleaning fluid onto the surface to be cleaned. As illustrated, the fluid delivery element comprises a solution tube 121 coupled between a fluid delivery nozzle 119 and adapter coupling 123. The fluid delivery nozzle 119 is preferably positioned within the agitator chamber 108 and can be orientated to distribute cleaning fluid directly on the surface to be cleaned or onto the agitator assembly 86 for distribution by the brushroll. The solution tube 121 receives cleaning fluid from a cleaning fluid source (not shown) by coupling the adapter coupling 123 with a supply tube (not shown) or other means in fluid communication with the cleaning fluid source. The cleaning fluid source may be carried by a vacuum cleaner, carpet cleaner, or extractor that also serves as the remote suction source 170. The fluid delivery element can further comprise an actuator (not shown) for controlling the dispensing of cleaning fluid through the nozzle 119. The actuator can be provided on the tool 80 itself, or on the remote suction source 170.

Now referring to FIGS. 5, 6 and 7, the tool 80 further comprises a suction selector valve assembly 96 for selective operation of either the agitator assembly 86 or the suction nozzle 100. The suction selector valve assembly 96 comprises a valve body 154 slideably received within the working arm conduit 94 and can selectively close the outlet opening 106. The valve body 154 comprises a valve head 156 that can be selectively received within the connecting conduit 95, which forms a valve seat 158 on one end thereof for the valve head 156. A selector button 98 fixedly attached to the valve body 154 is provided on the exterior of the main housing 82 for moving the valve body 154 between a first operating position (FIG. 7) and a second operating position (FIG. 8).

Referring to FIG. 7, in the first operating position, the suction selector valve assembly 96 is in an orientation in which the valve head 156 is received in the valve seat 158, thereby blocking fluid flow through the connecting conduit 95 and exposing the outlet opening 106. Accordingly, no suction is generated at the suction nozzle 100; instead, working air enters the impeller chamber 104 through the inlet opening 105 and passes through the outlet opening 106 into the working air conduit 94. The working air to approaches the turbine fan 140 at a tangential trajectory angle and, subsequently, induces rotation of the turbine fan 140 about its axle 146. The rotating turbine fan 140 drives the coupled turbine axle 146 and the drive pinion 148. The rotating drive pinion 148 drives the reduction spur gear train 152, which in turn drives the belt pulley 136 and results in cooperative rotation of the agitator assembly 86.

Figure 8:
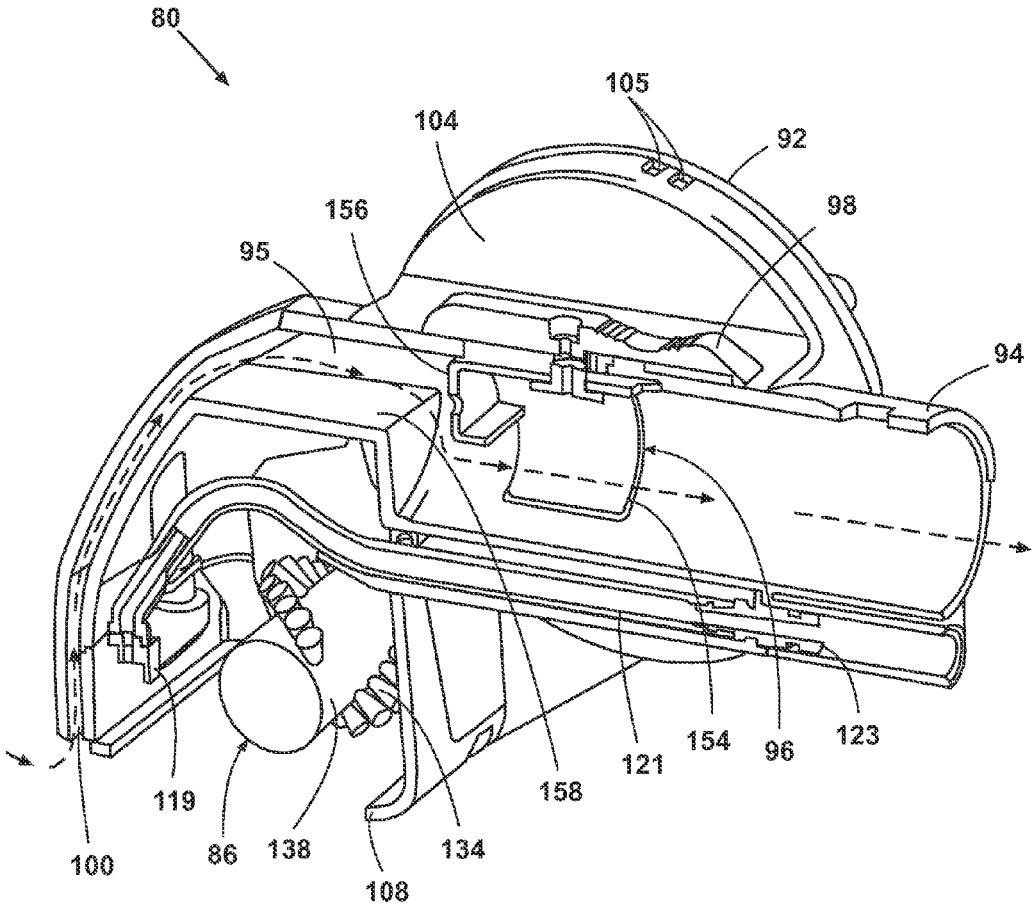
FIG. 8 is a sectioned partial view taken along line 7-7 of FIG. 4 showing the suction selector valve of the extractor accessory tool in a second operating position.

Referring to FIG. 8, the suction selector valve assembly 96 is moved to the second operating position by sliding the selector button 96 rearward. In the second operating position, the suction selector valve assembly 96 is in an orientation in which the valve head 156 is spaced from the valve seat 158 for fluid flow through the connecting conduit 95, and in which the valve body 154 closes or covers the outlet opening 106. Accordingly, the airflow path through the suction nozzle 100 is open and the airflow path through the impeller chamber 104 is closed. Air, cleaning fluid, and/or debris are drawn into the tool 80 at the suction nozzle 100 and pass sequentially through the connecting conduit 95 and the working air conduit 94. Thereafter, the air, cleaning fluid, and/or debris may enter the vacuum hose 160 and remote suction source 170, which may include a suitable collector (not shown) for storing material drawn through the tool 80.

Cleaning fluid may be dispensed from the fluid delivery nozzle 119 of the fluid delivery element with the suction selector valve assembly 96 in either the first or second operating position. Preferably however, cleaning fluid is dispensed with the suction selector valve assembly 96 in the first operating position so that the rotating agitator assembly 86 can be used to work the cleaning fluid into the surface to the cleaned.

Figure 4:
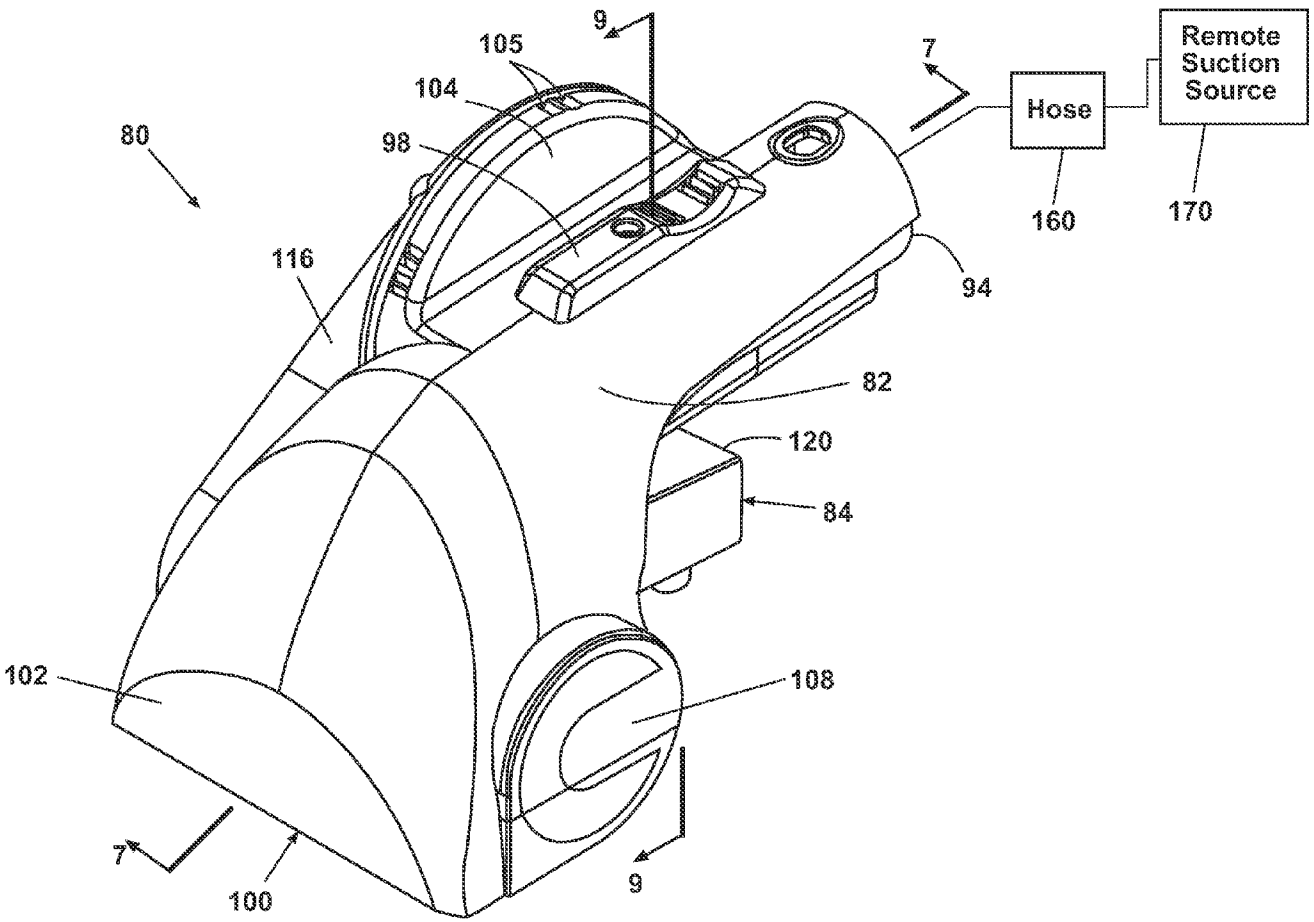
FIG. 4 is a front perspective view of an extractor accessory tool with an illumination element according to a second embodiment of the invention.
Figure 9:
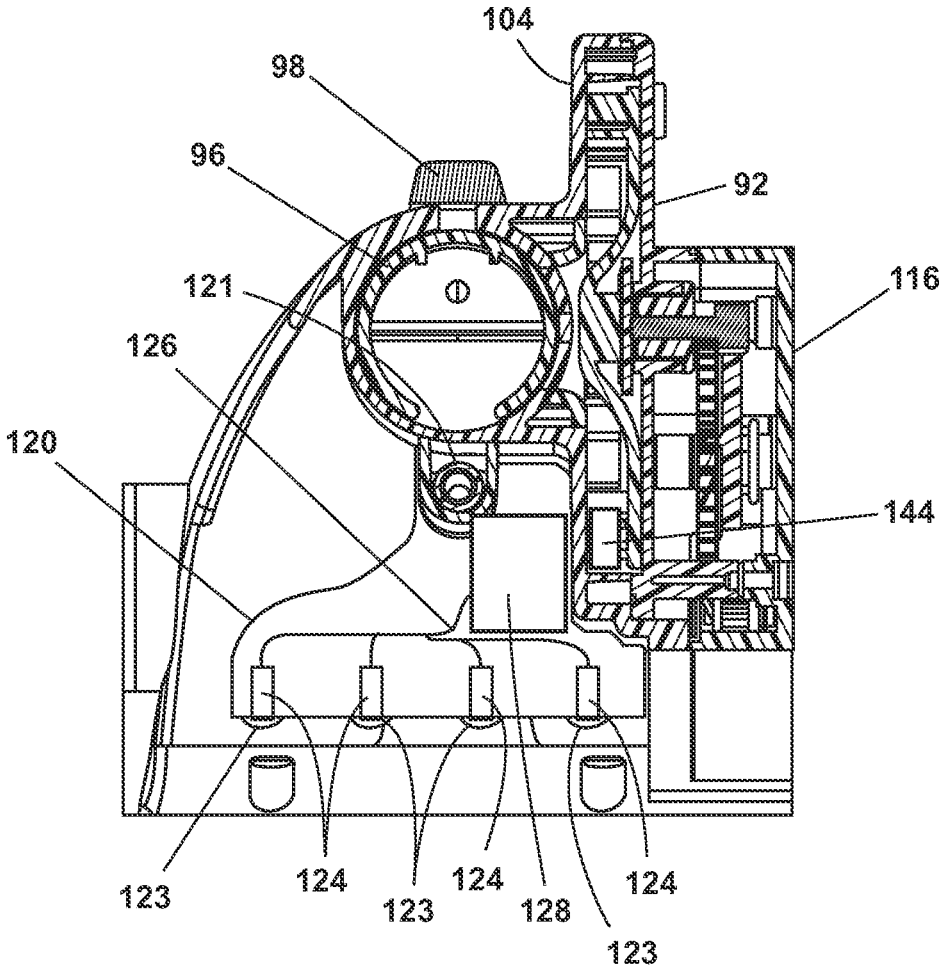
FIG. 9 is a section view taken along line 9-9 of FIG. 4 showing an inductor coil, a turbine fan, a magnet, and the illumination element of the extractor accessory tool.

Referring to FIGS. 4, 5, and 9, the illumination element 84 comprises a lighting element housing 120, at least one light emitting element 124, an inductor coil 128, and a plurality of magnets 144 that mount into associated recesses 142 on the turbine fan 140. The light emitting element 124 can be any of the types discussed above with respect to the first embodiment of the invention. The illumination element 84 further comprises the necessary conductor wires 126 and associated wire routing features and housing mounting features (not shown) required for successful assembly and operation as is known by one of ordinary skill in the art. The illumination element 84 can be user-adjustable to disperse light in downward or forward directions depending on the unique stain illumination or stain treatment requirements.

As shown in FIG. 4, the lighting element housing 120 can be mounted to an underside of the main housing 82, preferably near the agitator chamber 108 and contains the light emitting element 124, the inductor coil 128 and the necessary conductor wiring 126. The lighting element housing 120 can also be mounted in alternate locations on the tool 80. The lighting element housing 120 further comprises at least one lens 123 (FIG. 9) to pass light from the light emitting element 124 through the lighting element housing 120. The lens 123 can be transparent or translucent and can advantageously be convex-shaped to magnify the light emitted by the light emitting element 124. Alternately, the lighting element housing 120 can be made from a transparent or translucent material thereby allowing light from the light emitting element 124 to pass therethrough without need for a lens.

In operation, power is delivered to the illumination element 84 via an electromagnetic inductive circuit. The magnets 144 embedded into the periphery of the turbine fan 140 induce an electromotive force in the inductor coil 128 when the turbine fan 140 rotates, thereby generating an electromotive force (voltage) to power the light emitting element 124 that is connected in series with the inductor coil 128. Alternatively, the electromagnetic inductive circuit can be used to power other electrical elements including an ion generator 180 and/or an ozone generator 182 as previously described.

Figure 10:
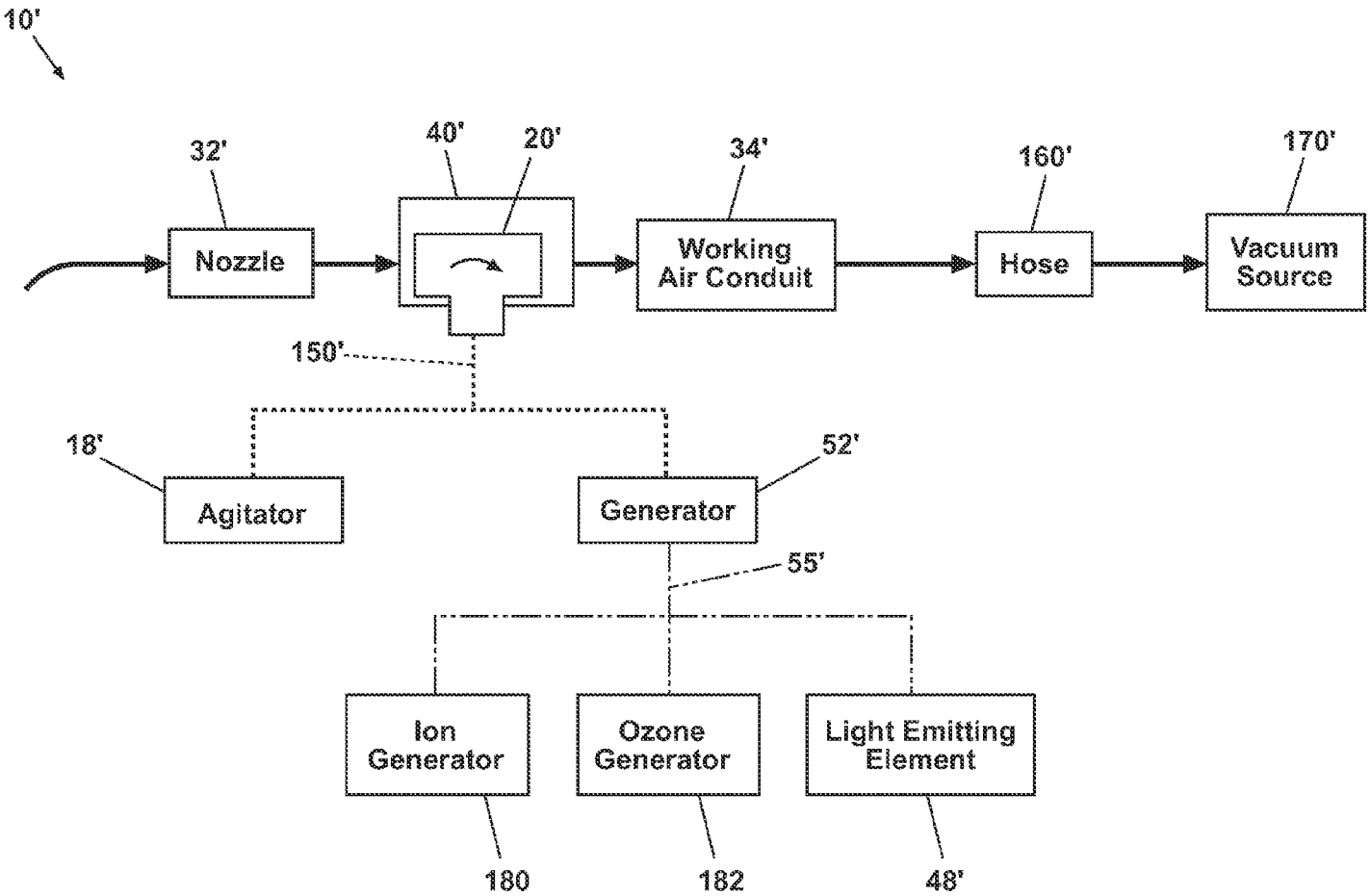
FIG. 10 is a schematic view of an alternate configuration of the accessory tool shown in FIG. 1.

Referring now to FIG. 10, showing a schematic view of a vacuum accessory tool 10' that includes an alternate powered electrical element comprising one of either an ion generator 180, an ozone generator 182, and/or a light emitting element 48'. The ion generator 180, ozone generator 182, and/or light emitting element 48' can be electrically connected and selectively energized by a turbine driven power generator 52'. Ion and ozone generators are well-known devices that can be utilized to provide air and surface purification. The purification process can eliminate undesirable odors from a surface to be cleaned. Ion generators typically disperse negatively or positively charged ions into the air. These ions attach to particulate matter such as dust, animal dander, mold spores, bacteria, and pollen giving them a negative or positive charge. The charged particulates then tend to attract to nearby surfaces such as furniture, carpet, or walls; or they attract to one another and settle out of the air due to their larger combined mass. When an ion generator is mounted to a vacuum accessory tool and configured to emit ions in close proximity to a cleaning surface, the ions can attract undesirable particulates residing on the cleaning surface, such as carpet fibers, and can attract and contain any particulates that are stirred up and introduced into surrounding air during the vacuuming process.

Ion generators are commercially available in various sizes ranging from large generators that are capable of purifying air in an entire room to smaller, portable and even wearable devices that can purify a smaller volume of air near a user or inside a vehicle. Representative examples of portable ionic generators are the AirTamer™ A3000 from Comtech Research, LLC (South Greenfield, Mo.), model XJ-850 from Heaven Fresh, Inc. (Toronto, Ontario), and model AS150MM from Wein Products, Inc. (Los Angeles, Calif.). Additional examples showing self-contained electro-kinetic ion generators can be found in U.S. Pat. Nos. 6,632,407 and 6,896,853 both to Lau et al, which are incorporated herein by reference in their entirety.

Ozone generators are well known in the art and can comprise corona discharge type generators or UV lamp generators. Both types emit ozone, which is an unstable molecule formed of three oxygen atoms. Upon encountering other molecules in the air or on surfaces, the ozone molecule can transfer an oxygen molecule thereby altering the molecular structure of the receiving substance. When bacteria, mold, mildew, or other micro-organisms are exposed to ozone, the organisms are altered and this alteration typically results in the death of those substances and subsequent elimination of its odor. Representative, non-limiting examples of ozone generators are described in the following patents: U.S. Pat. No. 5,866,082 to Hatton et al., U.S. Pat. No. 4,051,045 to Yamamoto et al., U.S. Pat. No. 4,461,744 to Erni et al., U.S. Pat. No. 5,268,151 to Reed et al., and U.S. Pat. No. 1,971,513 to Stoddard, which are all incorporated by reference in their entirety herein.

FIG. 10 shows a schematic diagram of a vacuum accessory tool 10' including either of an ion generator 180, an ozone generator 182, or a light emitting element 48'. The accessory tool 10' comprises a nozzle 32' that is fluidly connected to a turbine impeller chamber 40' and a working air conduit 34' for selective connection to a remote suction source 170' via a flexible hose assembly 160'. As previously described, the accessory tool 10' further comprises a power generator 52' operably coupled to an impeller assembly 20' via a drive belt 150' or other suitable means such as a gear train or the like. The power generator 52' is electrically connected to either of an ion or ozone generator 180, 182 via conductors 55' for delivering power to either device. The ion generator 180 or ozone generator 182 is preferably positioned at a lower portion of the accessory tool 10' near the front or rear of the nozzle opening 32' in close proximity to the surface to be cleaned.

In use, a remote suction source 170' is energized to create a working air flow through a hose 160' that connects the tool 10' with the remote suction source 170' at the working air conduit 34' to draw working air through the suction nozzle 32'. Working air is pulled through the suction nozzle 32', into the impeller chamber 40', and subsequently rotates the impeller assembly 20'. The rotating impeller assembly 20' drives the electrical generator 52', which, in turn, provides power to the ion generator 180 or ozone generator 182. When energized, the ion or ozone generator 180, 182 disperse ions or ozone molecules onto the surface to be cleaned and into the surrounding air that can purify and remove undesirable odors from the cleaning surface and from surrounding air.

While this invention has been specifically described in connection with certain specific embodiments thereof, it is to be understood that this is by way of illustration and not of limitation. As an example, power to the electrical element can be supplied from other types of power generators, such as a dynamo. Alternately, the power source for the illumination element could be an energy storage device, such as a battery, a rechargeable battery connected to a recharging circuit, line voltage, or other power sources not specifically described herein. Reasonable variation and modification are possible within the scope of the foregoing description and drawings without departing from the scope of the invention, which is described in the appended claims.

What is claimed is:

1. A vacuum accessory tool for cleaning a surface comprising:

a nozzle body;

a suction nozzle formed by the nozzle body;

an opening formed in the nozzle body and adapted to be connected to a suction source remote from the nozzle body for generating a working air flow from the suction nozzle through the nozzle body; and at least one light emitting element that emits light in an ultraviolet (UV) spectrum that will illuminate stains on the surface, the light emitting element being mounted on a leading edge of the nozzle body, whereby light is projected forwardly of the suction nozzle body so that stains on the surface will be visible to a user as the vacuum accessory tool is moved over the surface.

2. The vacuum accessory tool according to claim 1 wherein the at least one light emitting element is at least one light emitting diode (LED).

3. The vacuum accessory tool according to claim 2 wherein the at least one light emitting element is configured to emit light that sanitizes or disinfects the surface.

4. The vacuum accessory tool according to claim 3 wherein the at least one light emitting element further comprises a convex lens to disperse light emitted from the at least one light emitting element.

5. The vacuum accessory tool according to claim 1 wherein the at least one light emitting element is configured to emit light that sanitizes or disinfects the surface.

6. The vacuum accessory tool according to claim 5 wherein the at least one light emitting element further comprises a convex lens to disperse light emitted from the at least one light emitting element.

7. The vacuum accessory tool according to claim 1 wherein the at least one light emitting element further comprises a convex lens to disperse light emitted from the at least one light emitting element.

8. The vacuum accessory tool according to claim 1, further comprising a fluid delivery element for selectively distributing cleaning fluid onto the surface to be cleaned.

9. A vacuum accessory tool for cleaning a surface comprising:

a nozzle body;

a suction nozzle formed by the nozzle body;

an opening formed in the nozzle body and adapted to be connected to a suction source remote from the nozzle body for generating a working air flow from the suction nozzle through the nozzle body;

at least one light-emitting element that emits light in an ultraviolet (UV) spectrum that will illuminate stains on the surface, the light emitting element being mounted on a leading edge of the nozzle body, whereby light is projected forwardly of the suction nozzle body so that stains on the surface will be visible to a user as the vacuum accessory tool is moved over the surface; and a power generator mounted on the nozzle body, the power generator including an air-driven turbine for producing mechanical energy that is converted into electrical energy for powering the at least one light-emitting element.

10. The vacuum accessory tool according to claim 9 wherein the power generator further comprises a motor that is driven by the air-driven turbine and that forms an electromagnetic inductive circuit with the at least one electrical element to supply electrical energy to the at least one light-emitting element.

11. The vacuum accessory tool according to claim 9 wherein the power generator further comprises a plurality of permanent magnets mounted to the air-driven turbine and an inductor coil positioned adjacent the air-driven turbine so as to generate current in an electromagnetic circuit by the magnets cyclically passing across the inductor coil to supply electrical energy to the at least one light-emitting element.

12. The vacuum accessory tool according to claim 9, further comprising an agitator mounted to the nozzle body and operably coupled to the air-driven turbine for rotation therewith.

13. The vacuum accessory tool according to claim 12 wherein the agitator is a brush that is rotatable about a horizontal axis.

14. The vacuum accessory tool according to claim 1, further comprising a hair removal element on the nozzle body for aiding in the removal of hair from the surface to be cleaned.

* * * * *